United States Patent [19]

Shinoda et al.

[11] Patent Number: 4,926,095

[45] Date of Patent: May 15, 1990

[54] THREE-COMPONENT GAS MIXTURE FOR FLUORESCENT GAS-DISCHARGE COLOR DISPLAY PANEL

[75] Inventors: Tsutae Shinoda, Akashi; Toshiyuki Nanto, Kobe, both of Japan

[73] Assignee: Fujitsu Limited, Kawasaki, Japan

[21] Appl. No.: 156,743

[22] Filed: Feb. 18, 1988

[30] Foreign Application Priority Data

Feb. 19, 1987 [JP] Japan ..... 62-036984

[51] Int. Cl.[5] ..... G09G 3/10; H01J 1/62; H01J 63/04; H01J 17/20

[52] U.S. Cl. ..... 315/169.4; 313/484; 313/485; 313/637; 313/643

[58] Field of Search ..... 315/169.4; 313/483, 313/484, 637, 643, 638, 485; 340/781; 423/262

[56] References Cited

U.S. PATENT DOCUMENTS

| | | | |
|---|---|---|---|
| 3,903,446 | 9/1975 | Fein et al. | 315/169.4 |
| 3,914,635 | 10/1975 | Bode et al. | 315/169.4 |
| 4,081,712 | 3/1978 | Bode et al. | 313/643 |
| 4,549,109 | 10/1985 | Nighan et al. | 315/169.4 |
| 4,723,093 | 2/1988 | Nolan | 313/643 |
| 4,731,560 | 3/1988 | Ernsthausen | 315/169.4 |
| 4,737,687 | 4/1988 | Shinoda et al. | 315/169.4 |

FOREIGN PATENT DOCUMENTS

| | | | |
|---|---|---|---|
| 0087057 | 5/1982 | Japan | 313/643 |
| 1338238 | 11/1973 | United Kingdom . | |
| 1559272 | 1/1980 | United Kingdom . | |

*Primary Examiner*—Eugene R. LaRoche
*Assistant Examiner*—Michael B. Shingleton
*Attorney, Agent, or Firm*—Staas & Halsey

[57] ABSTRACT

A fluorescent gas-discharge color display panel, in which a fluorescent material is excited by a gas-discharge therein, contains a three-component gas mixture of neon, argon and xenon as the discharge gas. Typically, the argon gas component is in the range of from approximately 5 percent to approximately 80 percent, and that of the xenon gas from a minimum sufficient to maintain the Penning effect up to approximately 10 percent. The argon gas component contributes to the gas mixture producing a pure and high peak of green light spectrum and reduces the orange light spectrum emitted directly by the neon gas discharges. Other characteristics, such as operating voltages, brightness, luminous efficacy, and the panel operating life, are satisfactorily maintained. The improved color purity is advantageous for both single and multiple color display by the excited fluorescent material or materials.

18 Claims, 5 Drawing Sheets

THREE-COMPONENT GAS MIXTURE FOR FLUORESCENT GAS-DISCHARGE COLOR DISPLAY PANEL

BACKGROUND OF THE INVENTION

1. Field of the Invention

This invention relates to an improved fluorescent gas-discharge color display panel and, more particularly, to an improved mixture of the discharge gas for use therein, and which produces discharges of a wavelength capable of producing a color display by exciting the fluorescent material within the panel.

2. Description of the Related Art

Various types of fluorescent gas-discharge color display panels utilizing an ultra violet light generated by the gas-discharge, either DC (direct current) driven or AC (alternating current) driven, have been developed and are in use for displaying characters as well as images. As is well known, a color display is achieved by providing plural kinds of fluorescent materials in the discharge panel, each of which is excited by the ultra violet light generated by a respectively associated gas discharge.

A typical configuration of a panel utilizing a surface discharge, such as shown in FIGS. 1 and 2 hereof and also as disclosed in U.S. Pat. No. 4,638,218 by the present inventor, offers promising potential as a successful gas-discharge color display panel utilizing plural fluorescent materials. Basically, in the surface discharge display panel and as shown in FIG. 1, the discharge electrodes 3, 4 and 7 are provided on the inner surface of only one, i.e., the single substrate 1, of the pair of two substrates 1 and 2 comprising the panel envelope, and a fluorescent material layer 8 is provided on the inner surface of the other, facing, substrate 2. The fluorescent material layer 8 is excited by the ultra violet light generated by the gas discharges produced between the electrodes on the facing substrate 2, the color of the emitted light being determined by the specific fluorescent material. The electrodes 3 and 4 and the electrodes 7 are arranged in mutually orthogonal X and Y directions on the substrate 1, and are isolated from each other and from the gas discharge space. Particularly, the surfaces of these electrodes are covered with an insulating material layer 10 having high secondary-electron emissivity, such as magnesium oxide (MgO). Since the discharges occur between the electrodes on the substrate 1, this configuration prevents the fluorescent material layer 8 from being directly bombarded by the ions produced by the discharges and contributes to a long operating life of the fluorescent material.

Discharge gases which emit an ultra violet light for exciting the fluorescent material which, in turn, emits a visible light, have been extensively studied, as disclosed by Kagami et al. in U.S. Pat. No. 4,085,350. A well-known gas composition, or mixture, comprising two components, namely helium and xenon (He and Xe), has been used for a multiple color display discharge panel in which the purity of the emitted color is deemed highly important. The xenon gas functions to lower the required levels of both the discharge firing voltage and the discharge sustain voltage, in accordance with the well-known Penning effect. In this gas composition, however, the heavy xenon ions bombard the surface of the MgO insulating layer which is coated over the electrodes. Accordingly, the MgO layer deteriorates quickly and thus the panel has a short operating life.

Consideration has been given to adding argon gas as a third constituent to the above two-component gas mixture; since heavier than helium, argon effectively would function to lower the energy of the xenon ions which bombard the MgO surface. However, the resultant three-component gas mixture including argon introduces the problem of increasing the operating voltages of the panel.

An alternative gas mixture of two components (Ne+0.2% Xe—the percentage, as therein expressed and as appears hereinafter, indicating the ratio of the partial pressure of the gas) also has been used, particularly for exciting a mono- or single-color display discharge panel. The presence of the neon gas, however, results in the gas discharges emitting an orange light which, since in the visible spectrum, deteriorates the purity of the color of the light emitted by the fluorescent material layer.

A practical gas-discharge panel, and particularly one employing a fluorescent material layer for producing a color display as is here pertinent, must have a long operating life, low operating voltages, a sufficient level of luminance, or brightness, and sufficient color purity. Presently existing devices, however, have not achieved the simultaneous satisfaction of all of these requirements and thus there is a continuing need for improved such gas-discharge color display panels.

SUMMARY OF THE INVENTION

It is a general object of the invention, therefore, to provide a fluorescent gas-discharge color display panel having an improved discharge gas mixture, affording a long operating life, low operating voltages, an adequate level of luminescence, or brightness, and adequate color purity.

It is another object of the invention to provide a gas-discharge multiple-color display panel employing neon gas as a component of the discharge gas mixture, and having a spectrum of visual light emission in which the orange portion of the spectrum of light emission due to discharges of the neon gas is suppressed.

In accordance with the invention, the discharge gas for use in a fluorescent gas-discharge color display panel comprises a three-component mixture of xenon, neon and argon gases, the percentage content of the xenon gas being selected from the range of up to approximately 10 percent and that of the argon gas from approximately 5 percent up to 80 percent. The xenon and neon gas components, when in discharge, radiate ultra violet light for exciting the fluorescent material to emit visible, colored light and the argon gas component functions to suppress the orange spectrum of the neon gas discharges.

The above-mentioned features and advantages of the present invention, together with other objects and advantages, which will become apparent, will be more fully described hereinafter, reference being had to the accompanying drawings forming a part hereof, wherein like numerals refer to like parts throughout.

DETAILED DESCRIPTION OF THE PREFERRED EMBODIMENTS

Figure 1:
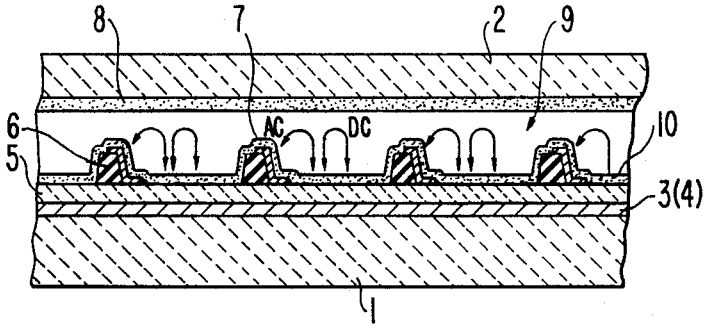
FIG. 1 (PRIOR ART)
FIG. 1 is a vertical cross-sectional view of a fluorescent gas-discharge color display panel of the surface discharge type.

In the following, the present invention is described in the context of the well-known structure and operation of a surface discharge color display panel, as shown in FIG. 1, and which furthermore is disclosed by T. Shinoda et al. in "Green Surface-Discharge Plasma Decode Displays", 1985 International Display Research Conference, pages 51–54.

In the vertical cross-section and fragmentary view of FIG. 1, a pair of glass substrates comprising a first substrate 1 and a second substrate 2 define the envelope of a gas-discharge panel. With concurrent reference to FIG. 2, which illustrates, schematically, the configuration and orientation of the discharge electrode structure employed in the panel of FIG. 1, a plurality of paired, parallel display electrodes 3 and 4 is arranged in a lateral (Y) direction on the first substrate 1 and a dielectric layer 5, formed of a low melting point glass, is formed thereover, except for the set of related portions AC and DC at each of the intersections of the (X) and (Y) electrodes as discussed in detail hereafter, a single exemplary set being designated by dashed circles in FIG. 2. Plural, parallel-spaced insulation ribs 6 having corresponding address electrodes 7 extending along the sides of the respective ribs 6 are formed on the dielectric layer 5 and extend in the longitudinal (X) direction. The intersections of the (X) and (Y) electrodes define corresponding discharge cells, which function in an manner described hereafter. The surfaces of the address electrodes 7, the dielectric layer 5 and the surfaces of the electrodes 3, 4 and 7 exposed through the openings AC and DC then are covered with a thin, surface dielectric layer 10 The dielectric layer 10 may be made of magnesium oxide, MgO, and be as thin as only several thousand Angstroms.

A layer 8 of fluorescent material is formed on the inner surface of the second substrate 2 and thus in opposed, facing relationship to the inner surface and associated discharge electrodes of the first substrate 1.

For a panel which is to produce a monochromatic (i.e., single color) display, the fluorescent layer 8 comprises, for example, a fluorescent material selected from the $Zn_2SiO_4$ family which emits a green light in response to excitation by the ultraviolet light emitted by the gas discharges, that material being coated uniformly over the entire interior surface of the substrate 2. For a polychromatic (i.e., multiple color) display panel, different fluorescent materials respectively corresponding to the visible colors to be emitted are selectively coated as individual spots on the second substrate 2 at positions corresponding to the discharge cells defined by the intersections of the (X) and (Y) electrodes of the substrate 1. Alternatively, the different materials may be coated as respective color "lines"; each color line, in this context, is aligned either with the plurality of cells along a respective set of paired electrodes 3 and 4, or with a corresponding address electrode 7 of the first substrate 1. By selective addressing of the discharge cells, therefor, the appropriate mix of primary colors may be emitted for producing the intended polychromatic display.

The substrates 1 and 2 are assembled in the opposed, facing relationship with their respective interior surfaces spaced by a predetermined distance, as shown in FIG. 1. They are then tightly vacuum sealed about their respective peripheries and the discharge gas 9 filled therein.

Figure 2:
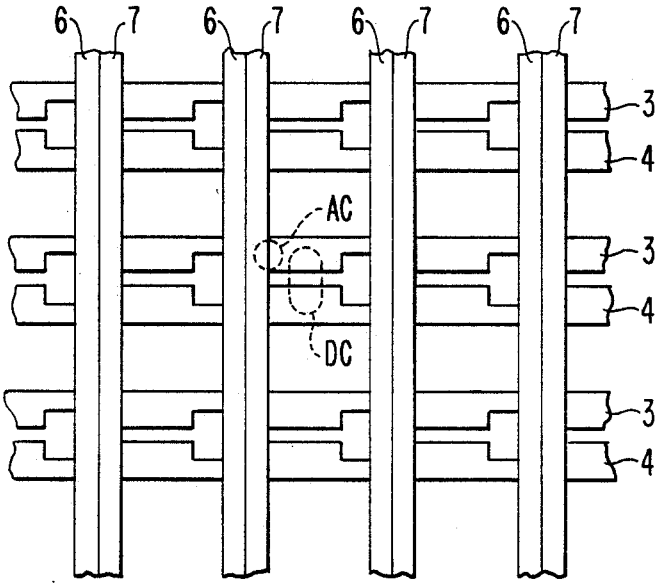
FIG. 2 (PRIOR ART)
FIG. 2 is a plane view of the discharge electrodes of the gas-discharge display panel of FIG. 1.

As before-referenced, the delineated areas AC and DC in FIG. 2 respectively comprise a discharge cell AC and a display cell DC, in closely adjacent positions as indicated and which together form a single pixel. Further, it will be understood that a pixel comprising a set of adjacent cells AC and DC is formed at each such intersection of the respective (X) electrodes 3, 4 and (Y) electrodes 7.

Operation of a surface gas-discharge display panel of the type illustrated in FIG. 1 and having the electrode arrangement as illustrated in FIG. 2 hereof is well-known in the art and, for example, may be as described in the abovereferenced U.S. Pat. No. 4,638,218. In general, a voltage, typically termed the "write" voltage $V_w$, higher than the firing voltage $V_f$, is first applied to initiate a discharge in all cells AC aligned in a given orthogonal direction, for example, between a selected pair of the plural pairs of electrodes 3 and 4 and all of the addressing electrodes 7. Thereafter, by virtue of the alternating sustain voltage which is typically maintained between the electrodes 3 and 4 of each pair thereof, the discharges are transferred from cells AC to the respective cells DC. Thereafter, the gas discharges created in the display cells DC comprising unnecessary pixels on that line, i.e., in that orthogonal direction as defined by the selected pair of electrodes 3 and 4, are selectively erased by the selective application of appropriate erasing voltages to the corresponding addressing electrodes 7. Repetition of this operation for each pair of the plural pairs of electrodes 3 and 4, in individual succession, thus allows all of the pixels on the panel to be selectively "written" and thus placed in discharge, to display the desired information.

Figure 3:
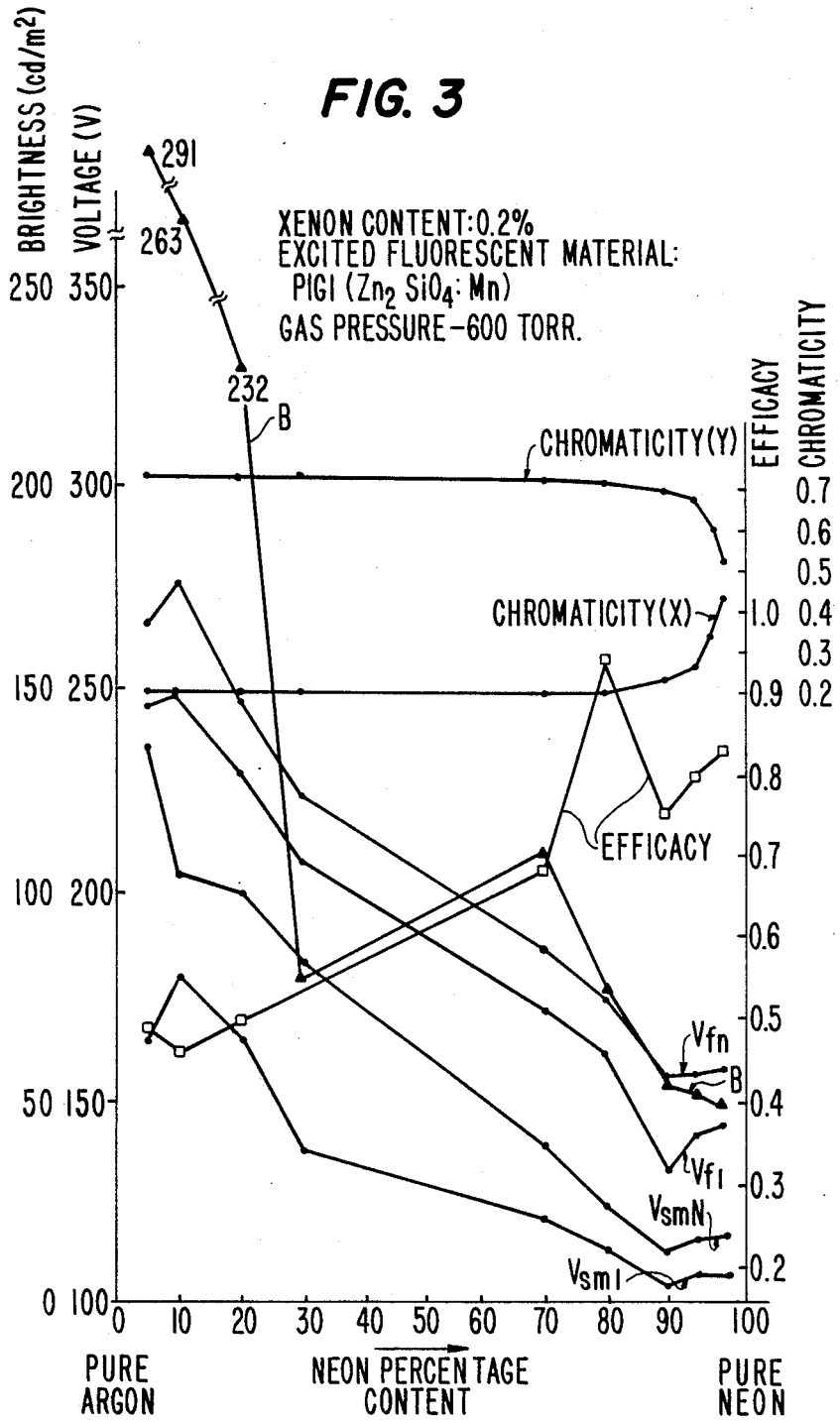
FIG. 3 is a graph in which the operating characteristics of a gas-discharge display panel of the type of FIG. 1 are plotted as a function of the percentage content of argon in a three-component discharge gas composition of argon, neon and xenon.

In accordance with the present invention, the characteristics of the above-described surface discharge display panel are greatly improved by improving the mixture, or composition, of the discharge gas 9 and in particular by adding argon gas within a prescribed percentage content range to a two component gas mixture, particularly of neon and xenon. The beneficial effects of the three-component gas mixture of the invention are revealed in the plots of FIGS. 3 and 4. In FIG. 3, the curves correspond to plots of operating characteristics of chromaticity (X), chromaticity (Y), brightness B, minimum firing voltage $V_{fl}$, maximum firing voltage $V_{fn}$, minimum sustain voltage $V_{sml}$, maximum sustain voltage $V_{smN}$ and luminous efficacy. Particularly, the plots and corresponding curves show the variations in the specified operating characteristics as a function of the variation in the percentage content of argon, and correspondingly of neon, in a three-component gas mixture including a constant 0.2 percentage content of xenon gas, and at gas pressure of 600 Torr. The fluorescent material layer 8 may comprise the widely used green fluorescent material P1G1 ($Zn_2SiO_4$:Mn), which is uniformly coated all over the inner surface of substrate 2.

As may be observed from a standard XYZ diagram of chromaticity values, for the chromaticity (X) and (Y) values plotted in FIG. 3, the presence of the argon gas in a percentage content of 5 percent or more results in substantial suppression, ranging to effective cancellation, of any visible orange light emission from the neon gas discharge, and improves the brightness B as well. In the range of more than 80 percent argon gas content, the operating voltages become so high as to increase the cost of the driving circuit, and the luminous efficacy is low; therefore, an argon gas percentage content of more than 80 percent is not suitable for practical use.

Figure 4:
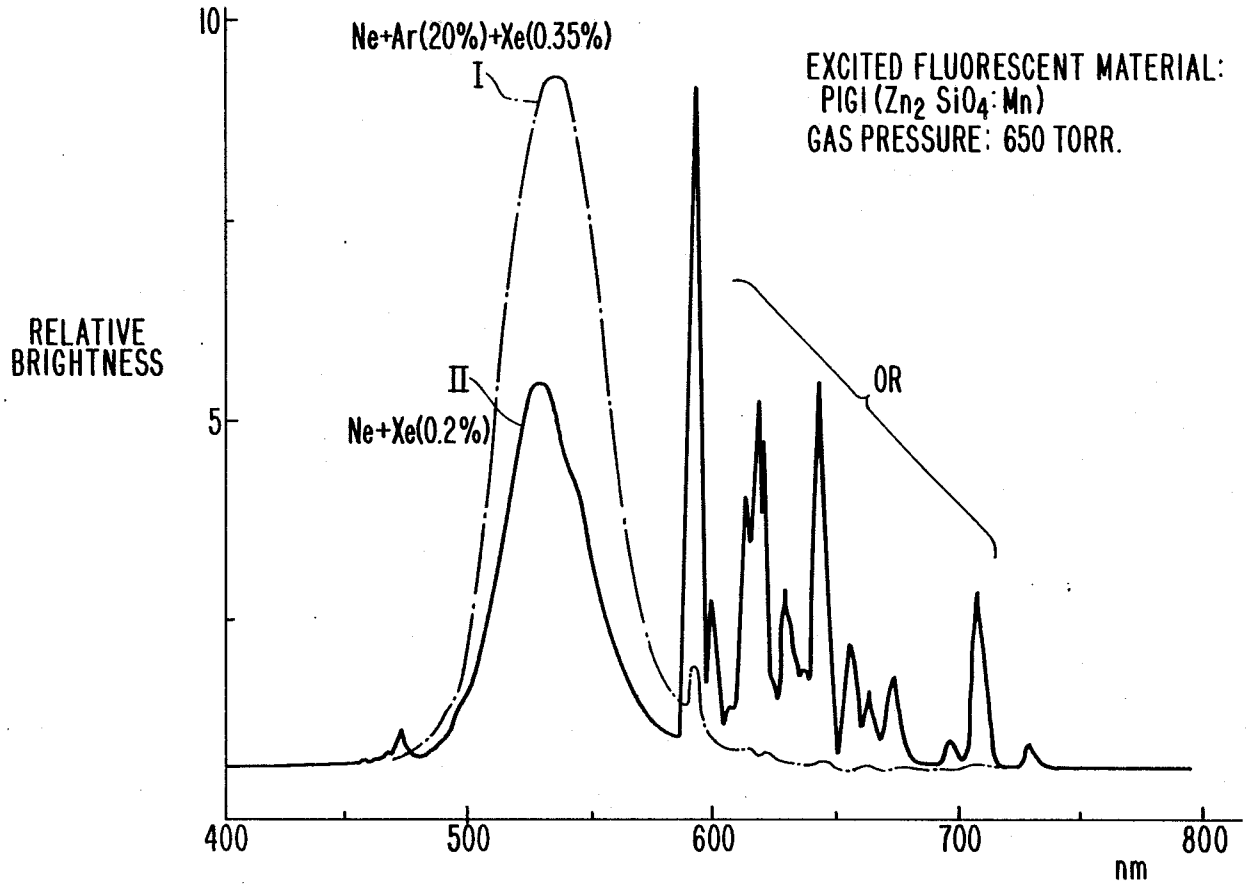
FIG. 4 is a graph of plots (I and II) of the light emission spectra produced by gas-discharge display panels of the type of FIG. 1, respectively employing a three-component discharge gas composition in accordance with the invention (I) and a two-component discharge gas composition in accordance with the prior art (II)

FIG. 4 shows a wavelength spectrum of the emitted light for the same fluorescent material P1G1 as in FIG. 3; chain line I is the emission spectrum of a three-component gas mixture in accordance with the invention, having the specific composition of Ne+Ar(20%)+Xe(0.35%) at a pressure of 650 Torr. Solid line II indicates the emission spectrum of a prior art two-component discharge gas having the composition of Ne+Xe(0.2%), for comparison. The differing percentage amounts of Xe in the respective discharge gases of the spectrum plots I and II is of no consequence to the comparison, since the Xe percentage content of a discharge gas has an insignificant effect on the emission spectrum as is apparent from the essentially flat chromaticity (X) and (Y) curves in FIG. 6, discussed below. Instead and as is well-known and discussed hereafter, the percentage Xe content affects the luminous efficacy and the operating voltage levels, parameters not related to the emission spectra comparison of FIG. 4.

As is evident from the plots of FIG. 4, the orange light components in the emission spectrum of the prior art gas, identified by the bracketed portion of plot II labelled "OR", do not appear in the plot I of the emission spectrum of the three-component gas mixture of the present invention; furthermore, the peak of the spectrum component of green light (I), having a wavelength of approximately 540 nm, is improved substantially, to almost twice that of the prior art gas (II).

Figure 5:
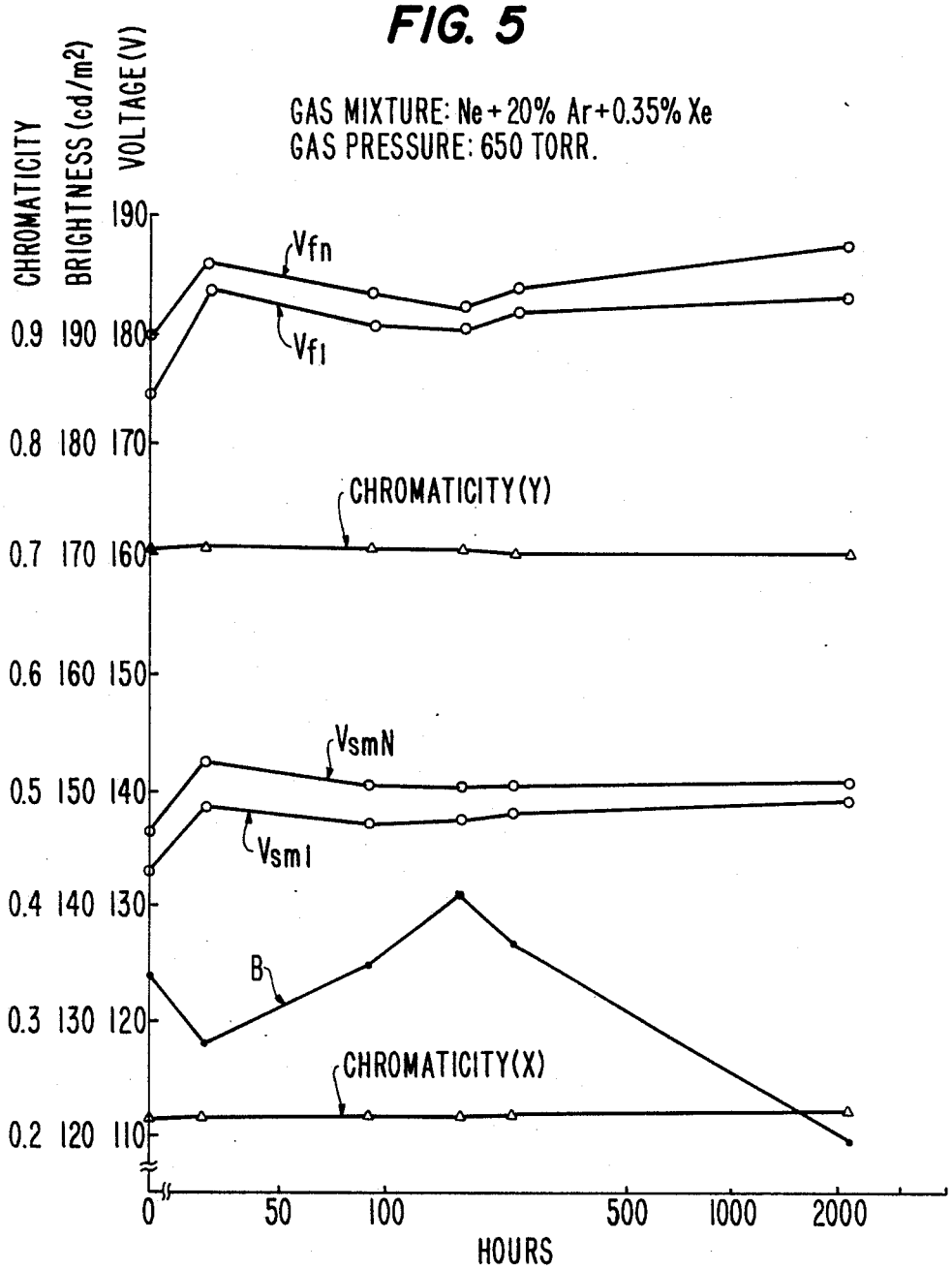
FIG. 5 is a plot of the operating life characteristics of a gas-discharge panel of the type of FIG. 1, employing a three-component gas mixture in accordance with the present invention.

FIG. 5 illustrates the operating life characteristics of the panel referred to in FIG. 4, and thus, in conventional fashion, presents plots of the brightness, chromaticity, and operating voltage values as a function of the hours of operation of the panel. The notations associated with each curve in FIG. 5 have the same significance as those in FIG. 3. As shown in FIG. 5, each of the voltage characteristics has an almost flat transition, except during the early stage of the operating life (i.e., the first several hours), evidencing that those voltage characteristics will continue to extend stably beyond 2000 hours. Curve B shows that the brightness is maintained at a minimum of 110 cd/m$^2$ over 2,000 hours, and thus more than satisfies the practical, minimum brightness requirement of 100 cd/m$^2$. The chromaticity (X) and (Y) curves furthermore reveal substantially no change in those characteristics over the entire 2,000 hour operating period of the data plots.

The xenon gas in the three-component gas mixture acts not only to provide the Penning effect, in accordance with the basic and original purpose of employing that gas, as well as lowering the firing voltage and the sustain voltage levels required for initiating and thereafter sustaining the gas-discharges, but also serves to emit, by itself, light in the ultra violet spectrum. The emitted ultra violet light during the discharges excites the fluorescent material and thus improves the luminous efficacy; further, the xenon ions have a considerable, beneficial effect on the memory of an AC (alternating current) drive type gas discharge panel by contributing to the wall charge. Thus, as shown by the gently sloped curves of chromaticity (X) and (Y) in FIG. 6, as the percentage content of the xenon gas component increases over the plotted range from approximately 1 percent up to 10 percent, the chromaticity (X) and (Y) values remain substantially stable, while both brightness (B) and efficacy are improved. The operating voltages, however, tend to increase, particularly as the xenon content increases over the range from 8 to 10 percent. Accordingly, while a xenon content below 10 percent is effective to achieve adequately low operating voltages for most practical panels, if it is important for a given panel to be assured of low operating voltages, a xenon content of 8 percent maximum is preferred. It should be recognized further that if the percentage content of xenon is reduced significantly below 1 percent, i.e., to the extent that the Penning effect is adversely impaired, the levels of the operating voltages required for initiating and maintaining discharges increase substantially. In that context, and for example with reference to the gas mixtures used in the panels for which data is plotted in FIGS. 3 through 5, the xenon content in the amounts of 0.2 percent or 0.35 percent, respectively, remains effective and is consistent with current practice, and even somewhat smaller percentage content of xenon will continue to be effective. Thus, it will be understood that the xenon percentage content may be substantially less than 1 percent, as in conventional practice, so long as sufficient xenon content is present to maintain the Penning effect; accordingly, the lower end of the range of the xenon content is determined by that minimum amount which will maintain the Penning effect, as a component of the three-component gas mixture of the present invention, the upper end of that range being, alternatively, less than approximately 8 or 10 percent in accordance with the desired levels of the operating voltages as hereinabove set forth.

Figure 6:
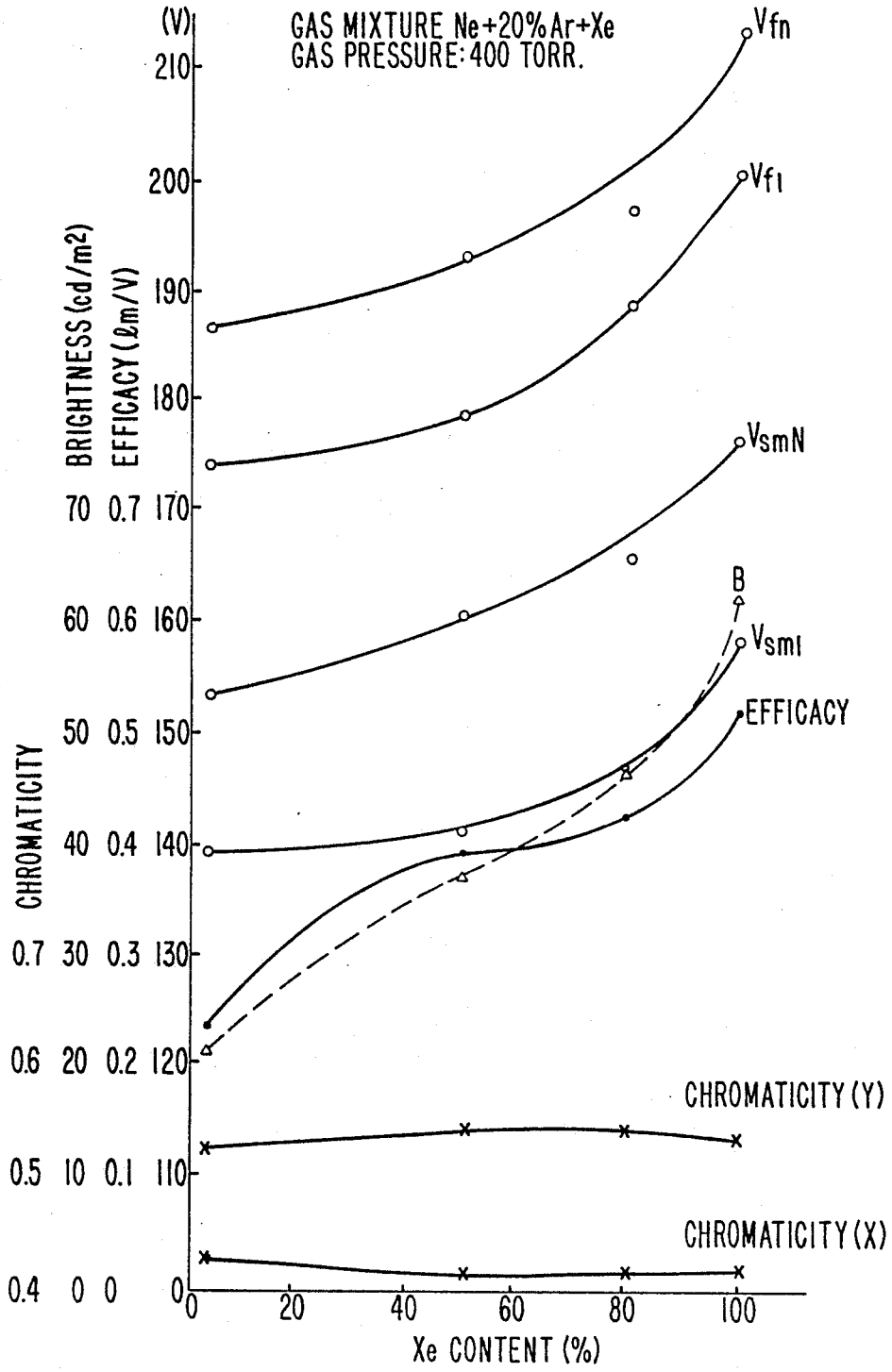
FIG. 6 is a plot, as in FIG. 3, of the operating characteristics of a fluorescent gas-discharge color display panel employing the three-component discharge gas mixture of the invention, as a function of the percentage content of xenon and wherein the percentage of argon is constant.

It is also to be understood that the respective panels for which the data is plotted in FIG. 6 versus that in FIGS. 3 and 5 have different structures and employ different fluorescent materials and configurations and thus that the curves of FIG. 6 are not intended for direct comparison with those of the prior FIGS. 3 and 5. Nevertheless, the relative operational characteristics as a function of the percentage of xenon content, as demonstrated in FIG. 6, remain applicable to other panels as well, such as that panel for which data is plotted in the preceding FIGS. 3 and 5.

Thus, in accordance with the invention, neon gas may be used as a component of a discharge gas mixture for single and/or multiple colored fluorescent gas-discharge display panels. Particularly, whereas such use of neon gas as a component of a discharge gas has been avoided heretofore because of its orange emission spectrum, the three-component gas mixture including argon gas as one component, in accordance with the invention, permits the use of neon gas while avoiding its characteristic orange light emission and provides the beneficial effects of long operating life, adequately low operating voltages, and pure fluorescent light emission of an adequate brightness.

Though in the above-described embodiments a fluorescent panel of a surface discharge type of an AC-driven gas-discharge display panel is referred to as an example, it is apparent that this invention is applicable to a wide variety of fluorescent gas-discharge display panels wherein the light generated by the gas-discharges excites one or more fluorescent materials respectively to emit visible display lights of one or more corresponding colors, regardless of the panel structure and/or the driving type.

Numerous modifications and adaptations of the invention will be apparent to those of skill in the art and thus it is intended by the appended claims to cover all such modifications and adaptations as fall within the true spirit and scope of the invention.

We claim as our invention:

1. A fluorescent gas-discharge color display panel comprising:

first and second substrates positioned substantially in parallel relationship and sealed about the respective peripheries thereof for defining a gas-discharge space therebetween;

a discharge gas received in the gas-discharge space, the discharge gas mixture consisting essentially of a three-component mixture of neon, xenon and argon gases wherein the percentage content of argon gas is more than approximately 5 percent;

a plurality of electrodes for discharging said discharge gas, said electrodes being positioned on an inner surface of at least one of said substrates and defining a plurality of discharge cells; and a layer of fluorescent material disposed in said discharge gas space and positioned relatively to the discharge cells so as to be excited by the ultra violet light generated by gas discharges therein.

2. The fluorescent gas-discharge color display panel of cl aim 1, wherein the respective percentage contents of the neon, xenon, and argon gases is selected to afford long operating life and low operating voltages of the panel with adequate levels of luminance and color purity.

3. The fluorescent gas-discharge color display panel of claim 1, wherein the percentage content of argon gas is selected from the range of from approximately 5 percent to approximately 80 percent.

4. The fluorescent gas-discharge color display panel of claim 1, wherein the percentage content of xenon gas is less than approximately 10 percent.

5. The fluorescent gas-discharge color display panel of claim 4, wherein the percentage content of xenon gas is less than approximately 8 percent.

6. The fluorescent gas-discharge color display panel of claim 1, wherein the percentage content of xenon gas is in the range from a minimum of a sufficient percentage content to maintain the Penning effect up to approximately 10 percent.

7. The fluorescent gas-discharge color display panel of claim 6, wherein the range of the percentage content of xenon gas is up to approximately 8 percent.

8. The fluorescent gas-discharge color display panel of claim 1, wherein the percentage content of the argon gas is in the range from approximately 5 percent up to approximately 80 percent, the percentage content of the xenon gas is in the range from a minimum sufficient to maintain the Penning effect up to approximately 10 percent.

9. The fluorescent gas-discharge color display panel of claim 8, wherein the range of the xenon gas percentage content is up to approximately 8 percent.

10. The fluorescent gas-discharge color display panel of claim 1, wherein the percentage content of the argon gas is sufficient to suppress the visible light emission spectrum of the neon gas discharges.

11. The fluorescent gas-discharge color display panel of claim 10, wherein the percentage content of the argon gas is more than approximately 5 percent.

12. The fluorescent gas-discharge color display panel of claim 10, wherein the percentage content of the argon gas is in the range of from approximately 5 percent to approximately 80 percent.

13. The fluorescent gas-discharge color display panel of claim 10, wherein the percentage content of the xenon gas is less than approximately 10 percent.

14. The fluorescent gas-discharge color display panel of claim 10, wherein the percentage content of the xenon gas is less than approximately 8 percent.

15. The fluorescent gas-discharge color display panel of claim 10, wherein the percentage content of the xenon gas is in the range from a minimum sufficient maintain the Penning effect to approximately 10 percent.

16. The fluorescent gas-discharge color display panel of claim 15, wherein the range of the percentage content of the xenon gas is up to a maximum of less than approximately 8 percent.

17. The fluorescent gas-discharge color display panel of claim 1, wherein:

said plurality of discharge cells comprise at least first and second pluralities of discharge cells respectively corresponding to at least first and second different colors to be emitted; and said layer of fluorescent material comprises at least first and second different types of fluorescent material having respective, different light emission colors and positioned so as to be individually, selectively excited by the ultra violet light emitted by the respective gas discharges of the respective first and second pluralities of discharge cells.

18. A fluorescent gas-discharge color display panel comprising:

first and second substrates positioned substantially in parallel relationship and sealed about the respective peripheries thereof for defining a gas-discharge space therebetween;

a discharge gas received in the gas-discharge space, the discharge gas mixture consisting essentially of a three-component mixture of neon, xenon and argon gases;

a plurality of electrodes for discharging said discharge gas, said electrodes being positioned on an inner surface of said first substrate and defining a plurality of discharge cells, surfaces of said electrodes being covered with a dielectric layer; and a layer of fluorescent material disposed on an inner surface of said second substrate and positioned relatively to the discharge cells so as to be excited by the ultra violet light generated by gas discharge therein.

* * * * *

UNITED STATES PATENT AND TRADEMARK OFFICE

CERTIFICATE OF CORRECTION

PATENT NO. : 4,926,095

DATED : May 15, 1990

INVENTOR(S) : Tsutae SHINODA et al.

It is certified that error appears in the above-identified patent and that said Letters Patent is hereby corrected as shown below:

Col. 3, line 51, change "an" to --a--;
line 56, after "10" (first occurrence) insert --.--.

Col. 4, line 35, change "abovereferenced" to --above-referenced--.

Col. 8, line 28, after "sufficient" insert --to--;
line 37, change "comprise" to --comprises--.

Signed and Sealed this

Fifteenth Day of October, 1991

*Attest:*

HARRY F. MANBECK, JR.

*Attesting Officer*

*Commissioner of Patents and Trademarks*